United States Patent [19]

Schulze et al.

[11] Patent Number: 4,501,044

[45] Date of Patent: Feb. 26, 1985

[54] APPARATUS FOR CLEANING COMPONENTS USED IN ELECTROLYTIC SMELTING

[75] Inventors: Hans-Horst Schulze, Lünen; Heribert Loweg, Werne; Karl-Heinz Schneider, Lünen, all of Fed. Rep. of Germany

[73] Assignee: Gewerkschaft Eisenhutte Westfalia, Lunen, Fed. Rep. of Germany

[21] Appl. No.: 563,485

[22] Filed: Dec. 20, 1983

[30] Foreign Application Priority Data

Dec. 22, 1982 [DE] Fed. Rep. of Germany ..... 3247368

[51] Int. Cl.[3] ..... B08B 1/04; A46B 13/02

[52] U.S. Cl. ..... 15/312 R; 15/77; 15/88; 15/307; 15/308; 51/273

[58] Field of Search ..... 15/21 D, 21 E, 77, 88, 15/102, 306 R, 306 A, 307, 308, 312 R; 51/23, 40, 80 R, 80 A, 268, 272, 273; 204/279

[56] References Cited

U.S. PATENT DOCUMENTS 1,411,321 4/1922 Wright ..... 15/53 AB 4,091,571 5/1978 Nilsson ..... 51/272

4,447,308 5/1984 Willans ..... 15/77

FOREIGN PATENT DOCUMENTS 0891400 12/1981 U.S.S.R. ..... 51/273

*Primary Examiner*—Edward L. Roberts

*Attorney, Agent, or Firm*—Sughrue, Mion, Zinn, Macpeak and Seas

[57] ABSTRACT

Apparatus for cleaning the so-called anode bars of electrodes re-cycled for use in electrolytic smelting comprises a frame with upstanding columns supporting a raisable and lowerable carriage. A table is displaceably supported between the columns on the carriage and a pair of depending swinging arms beneath the table support rotatable cleaning brushes which selectively engage on a bar to be cleaned. The brushes rotate inside extractor cowls from which air is sucked to withdraw dust and particles removed during cleaning. The cowls are urged with springs against the bar to be cleaned independently of the brushes to maintain the cowls in a set position regardless of any wear suffered by the brushes.

14 Claims, 4 Drawing Figures

APPARATUS FOR CLEANING COMPONENTS USED IN ELECTROLYTIC SMELTING

BACKGROUND TO THE INVENTION

The present invention relates to apparatus for use in cleaning metallic components usable in electrode assemblies for use in electrolytic smelting plants. Anode assemblies used in electrolytic smelting plants, particularly for use in the production of aluminium, are composed of metallic components—the so-called anode bars or holders—fixed to a carbon block. As the carbon block becomes consumed during operation, the anode assemblies have to be reprocessed from time to time and normally the bars are cleaned to remove encrustations therefrom the then re-processed. In conventional cleaning apparatus, surfaces of the bars are ground down with rotatable cleaning brushes. Apparatus of this type is described in German patent specification No. P31 42 849.5. In this known apparatus, a pair of rotatable cleaning brushes can be moved in relation to the bar to be cleaned and during use these brushes are urged against opposite surfaces of the bar while the brushes rotate. In order to remove the particles detached during the cleaning process, the known apparatus mounts the cleaning brushes within extractor cowls from which air is withdrawn continuously by suction.

A general object of the present invention is to provide an improved form of apparatus.

BRIEF SUMMARY OF THE INVENTION

In accordance with the invention, apparatus for cleaning components usable in electrolytic smelting has a pair of rotatable cleaning brushes mounted in cowls from which air can be extracted to withdraw material removed during cleaning, as is known. In contrast to known apparatus, however, the cowls are displaceable in relation to the brushes and the cowls are subjected to a displacement force in order to urge the cowls against the opposed surfaces of the component independently of the brushes. It is preferable for the cowls to be mounted in such a way that they can be displaced both towards and away from the component independently of the brushes. Because of this relative movement between the cowls and the brushes, the cowls can be maintained in a set position relative to the component regardless of the state of wear of the brushes. This ensures that air can be efficiently drawn through the cowls at all times. Conveniently, the cowls are each of double-walled construction with inlets for receiving air adjacent the associated cleaning brush and ducts which lead to a connector permitting the air to be withdrawn through the ducts by suction to pass through a pipe to a dust extractor, for example.

The cowls can also be provided with parts which form stops or projections which come to rest against the opposed surfaces of the component to be cleaned. This ensures that the gap between the component and the cowls through which air is taken in, will have a largely constant cross-section so that air flow speed is likewise more or less constant.

In a preferred arrangement the cowls are guided on guide bars fitted to carriers or support means supporting the brushes. Conveniently these carriers also support drive means for rotating the cleaning brushes. Springs can subject the cowls to a biasing force to urge the cowls towards the components to be cleaned. The cowls can have tubes guided on the guide bars and in this case the springs may act between the guide bars and the tubes.

Preferably the cowls and cleaning brushes are mounted on swinging arms which are pivotably linked to a support table or the like. These arms can then swing about axes parallel to the axes of rotation of the brushes. Means, such a piston-and-cylinder unit, can serve to bring the arms together or apart. The support table itself can be mounted for displacement in both horizontal and vertical directions in order to bring the brushes into various locations thereby to clean the component effectively. To this end the apparatus may employ a pair of columns with guides on which a carriage is mounted for raising and lowering. The table can then be mounted on guide rails or the like on the carriage and rendered adjustable transversely of the columns.

The invention may be understood more readily, and various other aspects and features of the invention may become apparent, from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
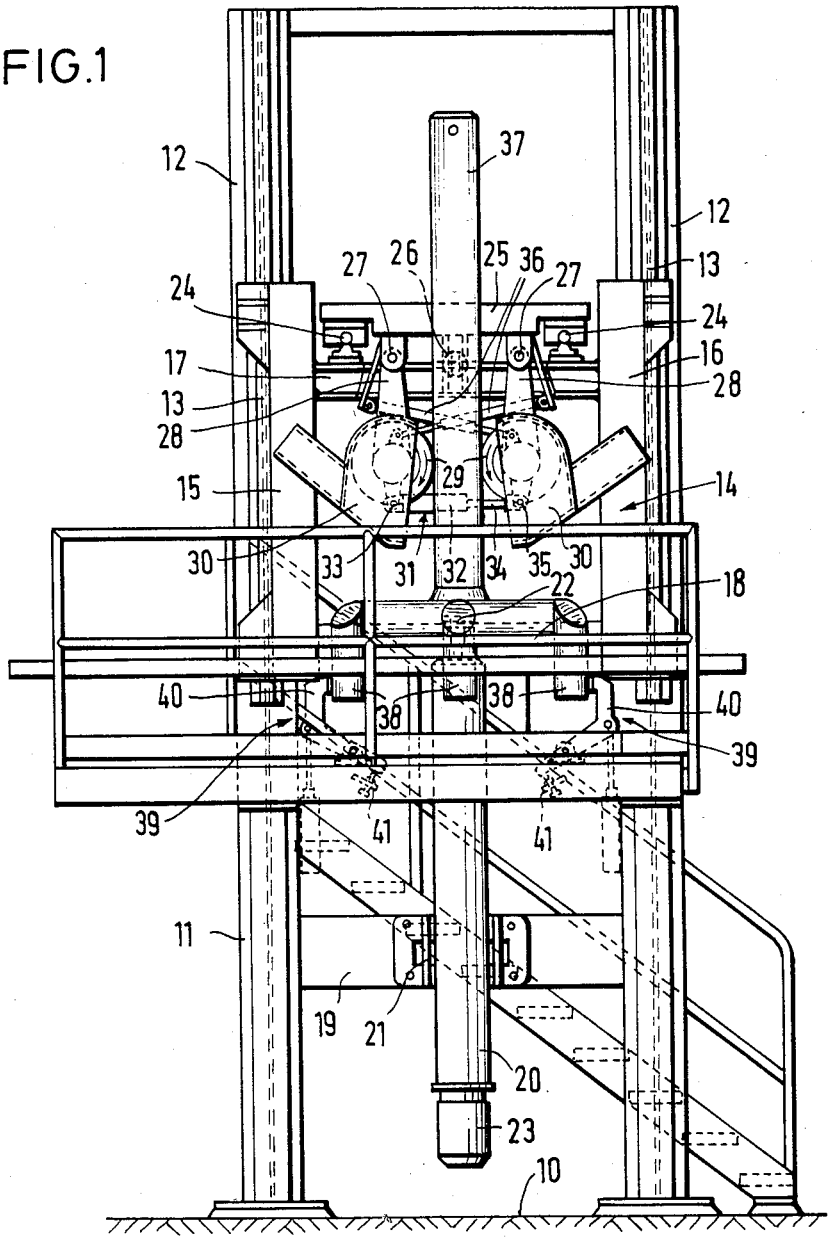
FIG. 1 is a diagrammatic end view of apparatus constructed in accordance with the invention.

As shown in FIG. 1, apparatus constructed in accordance with the invention has a main frame 11 which rests on a floor 10. The frame has two upstanding columns 12 which support a carriage 14 which can be raised and lowered. The carriage 14 has guide members 15, 16 which slidably engage on guides 13 on the columns 12. The guide members 15, 16 are interconnected via cross beams 17, 18. In the lower zone of the frame 11, a lifting device 20 is provided for raising and lowering the carriage 14. The lifting device 20 is connected by means of a joint 22 to the lower cross beam 18 of the carriage 14 and via a joint 21 to a cross beam 19 of the frame 11. The lifting device 20 can take a variety of forms, for example, a hydraulic or pneumatic mechanism or a spindle driven, possibly through gearing, by means of a motor 23.

The carriage 14 itself has guide tracks or rails 24 formed on the upper cross beam 17. These rails 24 slidably support a table 25 which is displaceable between the columns 12 and perpendicularly to the direction of movement of the carriage 14. In order to move the table 25 a piston and cylinder unit 26 is provided. This unit 26 is flexibly interconnected between the cross beam 17 of the carriage 14 and the table 25. The table 25 supports two depending arms 28 mounted thereto by means of pivot joints 27. Each of the arms 28 has a structure including a rotatable cleaning brush 29 at its free end. The brushes 29 can be made from steel wires. The brushes 29 are mounted to rotate about horizontal axes parallel to the axes of the pivot joints 27. The structure supported on each arm 20 also includes an extractor cowl 30 which partially surrounds the associated cleaning brush 29 and serves to remove material detached in the cleaning process by suction. The arms 28 are interconnected beneath the brushes 29 by way of an adjustment device 31 which here takes the form of a piston-and-cylinder unit 32. This unit 32 has its cylinder connected via a joint 33 to one arm 28 and its piston rod 34 connected via a joint 35 to the other arm 28. A pair of damping cylinders or dash-pots 36 are also connected between the arms 28 and the table 26 to absorb vibrations occuring during the cleaning process.

A workpiece to be cleaned is a metallic, more particularly, aluminium, component 37 used in an anode assembly for electrolytic smelting. The component 37 has a main elongate portion of rectangular cross section with three projections or nipples 38 at its lower end to which a carbon block is fixed after the component 37 has been cleaned and reprocessed. The component 37 is suspended within the apparatus from its upper end, for example, by means of a transporter or conveyor (not shown) which serves to bring the component 37 into position for cleaning and then transports the component 37 away from the apparatus after cleaning. In the lower region of the columns 12, location devices 39 are provided to locate the component 37 in the correct operating position for treatment by the brushes 29. The location devices 39 take the form of levers 40 which can be displaced, for example, with the aid of adjustment screws 41 or the like, to engage on the outermost projections 38 and thereby to align and support the component 37.

Figure 2:
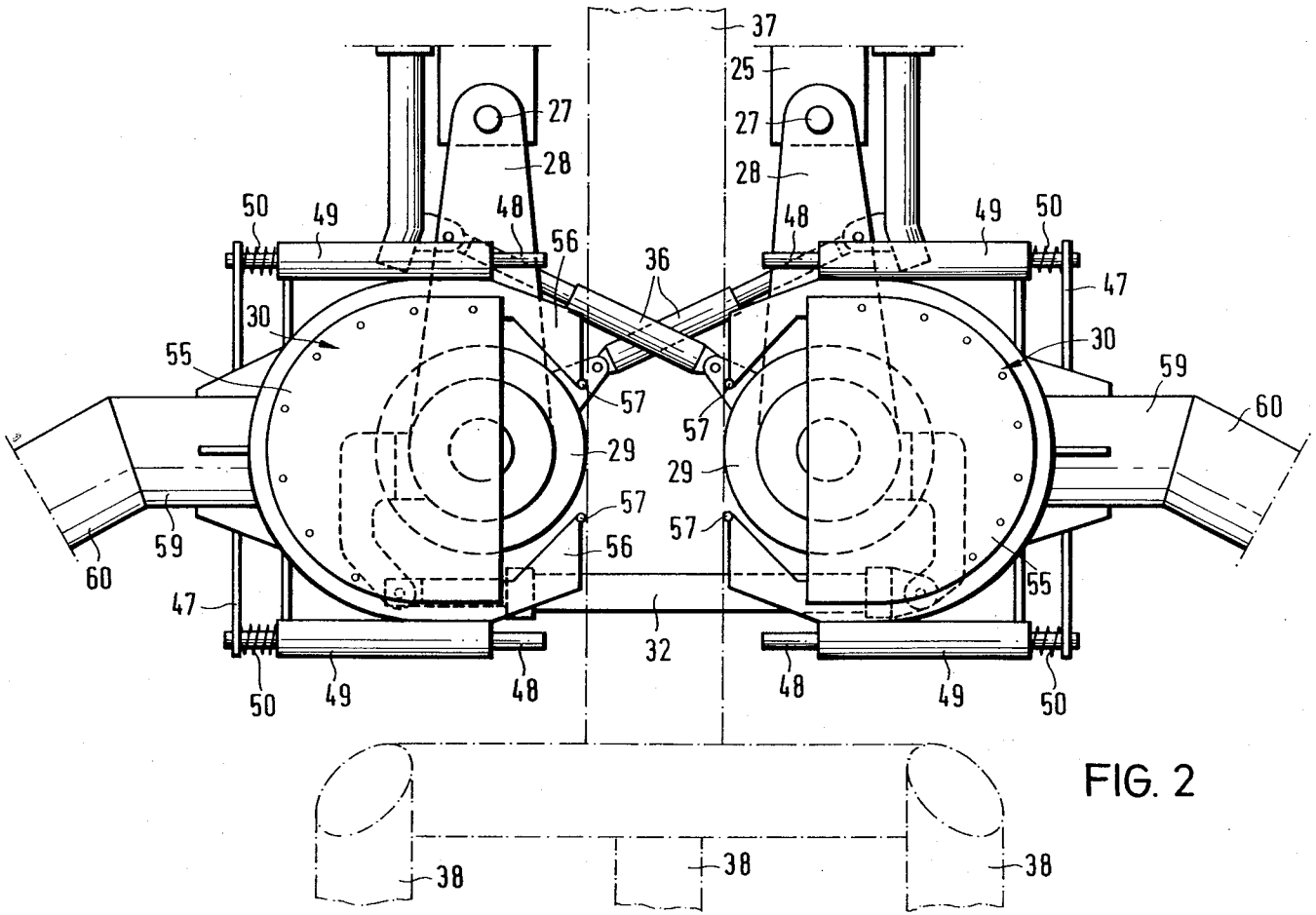
FIG. 2 is a diagrammatic end view of part of the apparatus, the view being taken on a somewhat larger scale to that of FIG. 1.
Figure 3:
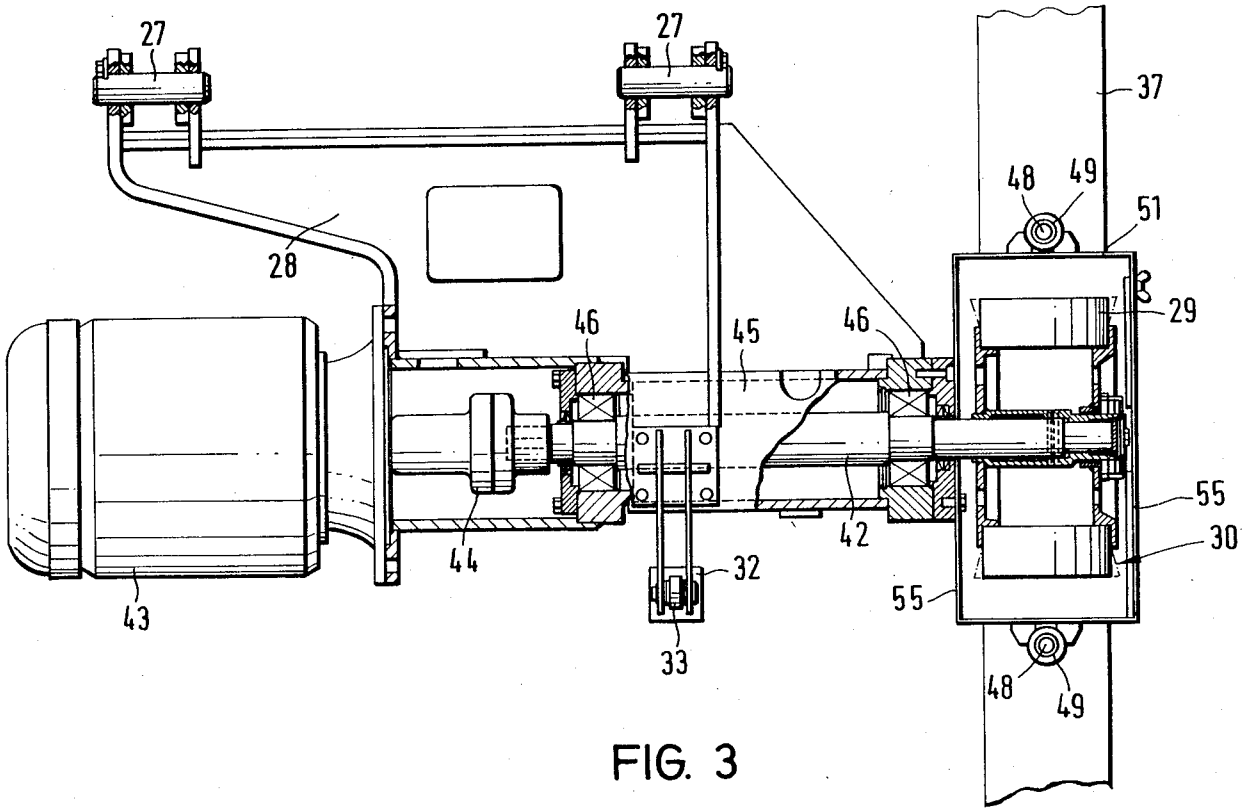
FIG. 3 is a part sectional side view of the part of the apparatus shown in FIG. 2.

FIG. 3 shows the structure including the brush 29 and cowl 30 on one of the arms 28. The brush 29 is mounted on the end of a shaft 42 driven by means of a motor 43 via a coupling 44. The motor 43 is fixed with a flange connection to the associated arm 28. A cylindrical housing 45 surrounds the coupling 44 and the shaft 42 and is likewise fitted to the associated arm 28 with a flange connection. Bearings 46 are provided in the housing 45 to rotatably support the shaft 42. The associated adjusting unit 32 is also connected to the housing 45 with the aid of a bracket. As shown in FIG. 2, a further support or bracket 47 is also fixed to each of the housing 45, to extend around the rear parts of the associated extractor cowls 30. Each bracket 47 supports a pair of parallel guide rods 48 and each cowl 30 has guide tubes 49 which are guided for displacement on the rods 48. Springs 50 are provided on the guide rods 48 to urge the tubes 49 and hence the cowls 30 towards one another. The tubes 49 may simply slide on the rods 48 or linear bearings can be provided between these components 48, 49 to permit the extractor cowls 30 to move smoothly towards or away from one another.

Figure 4:
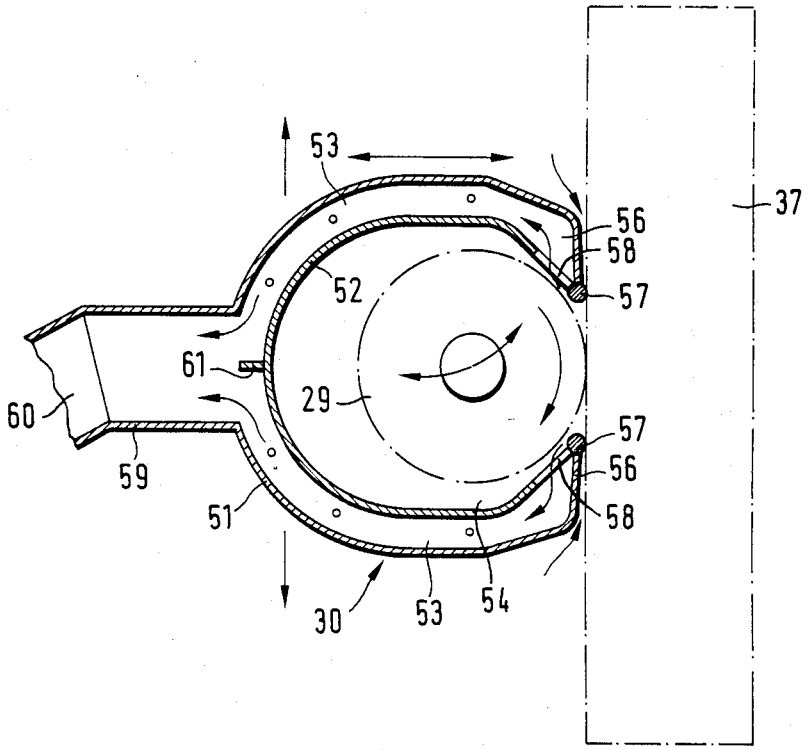
FIG. 4 is a diagrammatic sectional view of one of the extractor cowls of the apparatus shown in FIGS. 1 to 3.

As shown in FIG. 4, each cowl 30 has a outer casing 51 and an inner casing 52 which define ducts or suction channels 53 therebetween. The associated cleaning brush 29 mounted on the drive shaft 42 is located in a chamber 54 defined inside the inner casing 52. Arcuate closure plates 55 (FIG. 2) are fitted to the casings 51, 52 to partly close-off the chamber 54 axially of the drive shaft 42. The casings 52, 51 extend beyond the cover plates 55 as indicated by reference numerals 56 to form stops by means of which the cowl 30 can be pressed against the component 37 under the biasing effect of the springs 50. Conveniently, these projecting parts 56 of the cowl 30 are provided with beads, strips, bars or, more preferably, rollers 57 which actually engage on the component 37. The inner casing 52 is provided with apertures 58 through which air is sucked in order to withdraw particles detached by the brushes 29. The contaminated air flows through the channels 53 and the outer casing 51 is formed with a connector 59 which leads to a suction pipe 60. A deflector 61 on the inner casing 52 serves to deflect the currents of air from the channels 53 into the connector 59. The connectors 59 of the cowls 30 and the pipes 60 is passed back to a dust separator.

During operation, the component 37 is conveyed into the apparatus and aligned therein with the locating devices 39. The table 25 is then moved together with the associated parts into a working position and the adjustment unit 32 is operated to swing the arms 28 together to bring the brushes 29 into the operating position engaging the component 37. The springs 50 then serve to press the cowls 30 with their locating parts 56, 57 against the component 37. The entire carriage 14 is moved up or down or reciprocated as a result of which the component 37 is cleaned on two opposite sides by means of the brushes 29. The component 37 can then be reorientated to clean the other sides. During the cleaning operation the springs 50 maintain the position of the cowls 30 with respect to the component 37 but the unit 32 is subjected to a pre-determined pressure in order to apply the rotating brushes 29 against the component 37 with a constant force regardless of their diameter and thus irrespective of the degree of wear suffered. Suction is applied to the pipes 60 in order to withdraw the contaminated air.

We claim:

1. In an apparatus for cleaning components usable in electrodes for electrolytic smelting; said apparatus including a pair of rotatable cleaning brushes mounted in cowls from which air can be extracted to withdraw material removed from a component during cleaning and means for adjustably moving the brushes in relation to a component to be cleaned to bring the brushes into contact with opposed surfaces of the component; the improvement comprising the cowls being displaceable in relation to the associated cleaning brushes and means is provided for subjecting the cowls to displacement force to urge the cowls towards the opposed surfaces independently of the brushes.

2. Apparatus according to claim 1, wherein said means for subjecting the cowls to displacement force takes the form of springs.

3. Apparatus according to claim 1, wherein the cowls have parts which are engageable with the opposed surfaces of the component and the displacement force biases said parts against the opposed surfaces during use.

4. Apparatus according to claim 1, and further comprising support means for supporting the rotatable brushes and guide rods carried by the support means wherein the cowls are supported and guided for displacement on the guide rods.

5. Apparatus according to claim 4, wherein the cowls are connected to tubes guided on the guide rods and the means for subjecting the cowls to displacement force takes the form of springs operable to bias the tubes longitudinally in one direction relative to the associated guide rods.

6. Apparatus according to claim 4, wherein the support means also support drive means for driving the rotatable cleaning brushes.

7. Apparatus according to claim 6, wherein the support means comprises a pair of pivotable arms and the drive means comprises a drive motor supported on each arm and coupled via a drive shaft disposed in a housing to the associated cleaning brush and wherein brackets fixed to the housings support the guide rods.

8. Apparatus according to claim 1, wherein the brushes and cowls are mounted on arms which are pivotably supported on a mobile table and means is provided for swinging the arms to adjust the position of the brushes.

9. Apparatus according to claim 8, and further comprising a pair of columns with guides on which a carriage is mounted for raising and lowering, wherein the table is supported on the carriage for movement in a direction transversely of the columns.

10. Apparatus according to claim 8, wherein damping means is connected to the arms.

11. Apparatus according to claim 1, wherein each rotatable brush and associated cowl is mounted to a carrier which is displaceable towards and away from the opposed surfaces of the component and means is provided for moving the carriers towards and away from one another.

12. Apparatus according to claim 1, wherein each cowl has a inner and outer casing with a channel therebetween through which air is withdrawn.

13. Apparatus according to claim 1, wherein there is further provided locating means for aligning and supporting the component during the cleaning process.

14. Apparatus according to claim 1, wherein each cowl is of double-walled construction with inlets for receiving air adjacent the associated cleaning brush and ducts which lead to a connector permitting the air to be withdrawn through the ducts by suction.

* * * * *